US006785967B1

(12) United States Patent
Allievi

(10) Patent No.: US 6,785,967 B1
(45) Date of Patent: Sep. 7, 2004

(54) CLAM AND OYSTER OPENER

(76) Inventor: Francis Todd Allievi, 42 W. Central Ave., Maywood, NJ (US) 07607

( * ) Notice: Subject to any disclaimer, the term of this patent is extended or adjusted under 35 U.S.C. 154(b) by 0 days.

(21) Appl. No.: 10/436,633

(22) Filed: May 13, 2003

(51) Int. Cl.[7] ..... A47J 43/26
(52) U.S. Cl. ..... 30/120.1; 452/17
(58) Field of Search ..... 30/120.1, 123.7, 30/120.3, 120, 120.4; 452/17; D7/693, 396, 696

(56) References Cited

U.S. PATENT DOCUMENTS 508,355 A * 11/1893 Streeter et al. ..... 30/120.3

3,846,908 A * 11/1974 Allievi ..... 30/120.1

* cited by examiner

*Primary Examiner*—Douglas D Watts
(74) *Attorney, Agent, or Firm*—Richard A. Joel, Esq.

(57) ABSTRACT

A handheld oyster and clam opener includes a pair of cooperating pivotal members. One member includes a handle and a curved toothed portion to hold a clam or oyster in position at one end. The opposing member includes a handle and a knife-like wedge along which a protruding wedge is slidable. The protruding wedge is used to open oysters and is moved to one end to open clams with the knife-like wedge both operations requiring a single stroke. A scoop mounted to the toothed portion is used to remove the clam or oyster from the shell.

5 Claims, 2 Drawing Sheets

CLAM AND OYSTER OPENER

BACKGROUND OF INVENTION

This invention relates to a hand-operated device for opening oysters, clams and similar shellfish. The hand-operated tool includes a curved toothed member, which cooperates with an opposing member having a wedge slidably and adjustably mounted thereon for opening oysters. The portion along which the wedge slides comprises a knife like cooperating portion to open clams. The members are pivotably mounted together at one end and both include a handle portion at the other end to hand squeeze and force the clams or oysters apart in a single stroke.

The prior art includes the conventional but dangerous method of opening clams and oysters with a knife. This results in considerable loss of product since there are many oysters or clams, which cannot be opened in this fashion. The primary drawback, however, is the difficulty in gripping and opening the shellfish, which are often slippery with a knife in a safe and efficient manner.

Various devices have been developed including the disclosures of U.S. Pat. Nos. 4,133,078 and 3,846,908, which relate to handheld devices. The aforesaid patents each show two pivotal arms but the blade for engaging the oysters is not movable along an elongated arm. Further, the patents fail to disclose a device, which has no knife protrusion but includes a scoop on one of the members.

U.S. Pat. No. 3,231,930 to Berry discloses a knife having a depending wedge fixedly mounted to the blade handle but the knife is not pivotably mounted to the vertical member. The Berry opener includes a fixed stand and lacks the flexibility and speed of applicant's device.

Other patents of interest include design U.S. Pat. Nos. 196,381: 1,071,352; 189,966; and 210,032; as well as U.S. Pat. Nos. 5,482,500 and 4,348,788. None of the patents depict the unique combination, which includes a slideable wedge moveable along a wedge shaped knife-like member to open oysters or clams in cooperation with an opposing pivotally connected toothed member. The device is also safer, inexpensive and easy to use. It results in less product loss and portable and space efficient.

SUMMARY OF INVENTION

Oysters and clams are often difficult to open since the opposing shells are usually slippery and are held together by a muscle and present little or no opening to pry the shells apart.

This invention comprises a pair of members pivotably mounted together at one end and having a handle portion at the other end. One of the members comprises a curved toothed portion having a scoop like member mounted adjacent the end thereof to remove the clam or oyster. The member is curved with serrations thereon to hold a clam or oyster at one end while pressure is exerted by the other member to open the clam or oyster. The other member includes a tapered knife like portion to engage and open clams and a wedge like member slidably mounted on the knife like portion to engage and open oysters. The wedge like member is slid to one end when it is necessary to open clams.

Accordingly, an object of this invention is to provide a new and improved device for opening clams, oysters and other shellfish.

Another object of this invention is to provide a new and improved device for gripping, opening and shucking clams and oysters.

A further object of this invention is to provide a new and improved hand held device for opening clams and oysters wherein pivotably connected members cooperate to hold and open said clams and oysters.

A more specific object of this invention is to provide a new and improved hand held opening device for clams and oysters which include a curved toothed member which cooperates with a member having an adjustably mounted wedge member slidable along a knife like portion of an opposing member to engage and open oysters while the knife like portion is used to open clams with the wedge member moved to the end of said knife like portion.

BRIEF DESCRIPTION OF DRAWINGS

The above and other objects and advantages of this invention may be more clearly seen when viewed in conjunction with the accompanying drawings wherein

FIG. 2 is a front plan view of the device of FIG. 1 in an open operative position with an oyster; and.

DETAILED DESCRIPTION

Figure 1:
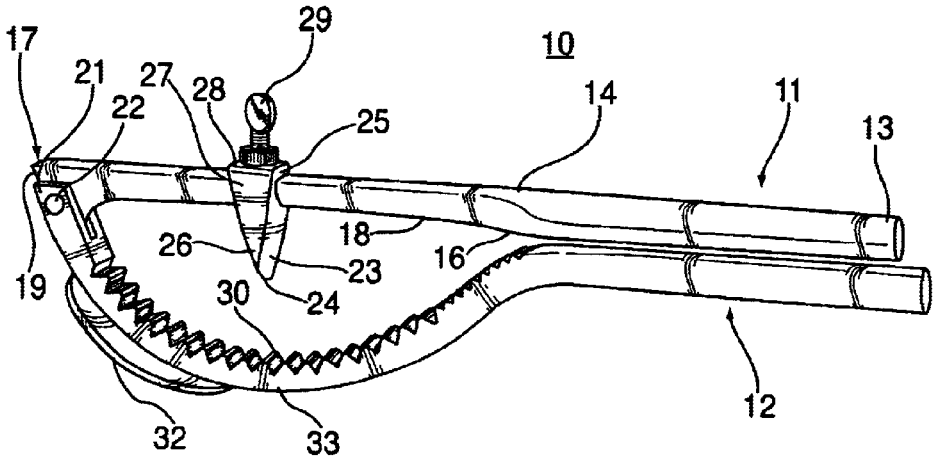
FIG. 1 is a front plan view of the opening device of the present invention.

The Invention relates to a device 10 for opening clams and oysters in a safe and expeditious manner. As shown in FIG. 1 the opening device 10 comprises a pair of pivotably connected members or legs 11 and 12. The upper member 11 comprises a cylindrical handle portion 13 at one end and an elongated wedge shaped portion 14 extending from the end 16 of the handle portion 13 to the other end 17 of the member 11. The sharp edge 18 of the knife-like wedge portion 14 extends downwardly towards the opposite member 12. At the end 17, a portion 19 extends downwardly and includes a transverse aperture 21 to receive a pin 22.

A wedge shaped member 23 is slidably mounted on the portion 14 of member 11. The member 23 is designed for opening oysters and includes a tapered end wedge or knife 24 and an aperture 25 in the body portion 26, which slides along the elongated wedge shaped portion 14. The upper portion 27 includes an aperture 28, which is engaged by a setscrew 29 to lock the member 23 in a fixed position against member 11.

The lower member 12 includes a curved toothed or toothed surface 30 extending from the handle 12 at one end to the pivotal pin portion at the other end, which serves to hold one end of a clam or oyster while the adjustable wedge 23 is moved into or out of position along the wedge shaped portion 14. The wedge knife 24 is inserted between the oyster shells. The handles 12 and 13 are squeezed together forcing the oyster shells apart. For clams, the wedge shaped member 23 is moved to one end of knife-like wedge portion 14 and the sharp edge 18 is used to force open a clam. After the clam or oyster is opened, the scoop 32, which is mounted to the outside 33 of the curved toothed surface 30 is used to scoop the clam or oyster from the shell.

Figure 2:
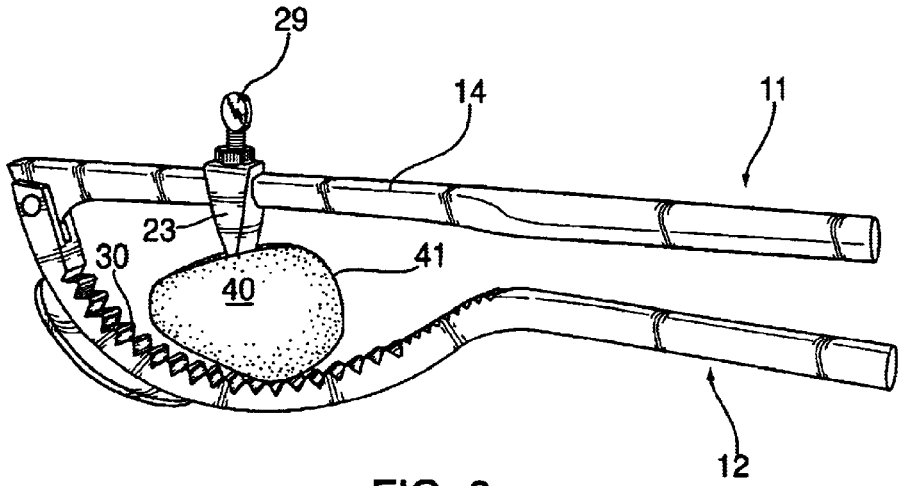

In operation, as shown in FIG. 2, an oyster 40 is placed in the toothed portion 30 at one end and the wedge shaped member 23 moved into position opposite the other end of the oyster 40. The member 23 is locked in position with the setscrew 29 and the handles 11 and 12 squeezed together. The curved nature of portion 30 accommodates oysters 40 of different sizes. The member 23 spreads the often difficult to open oyster shells 41 apart in an expeditious and safe manner.

Figure 3:
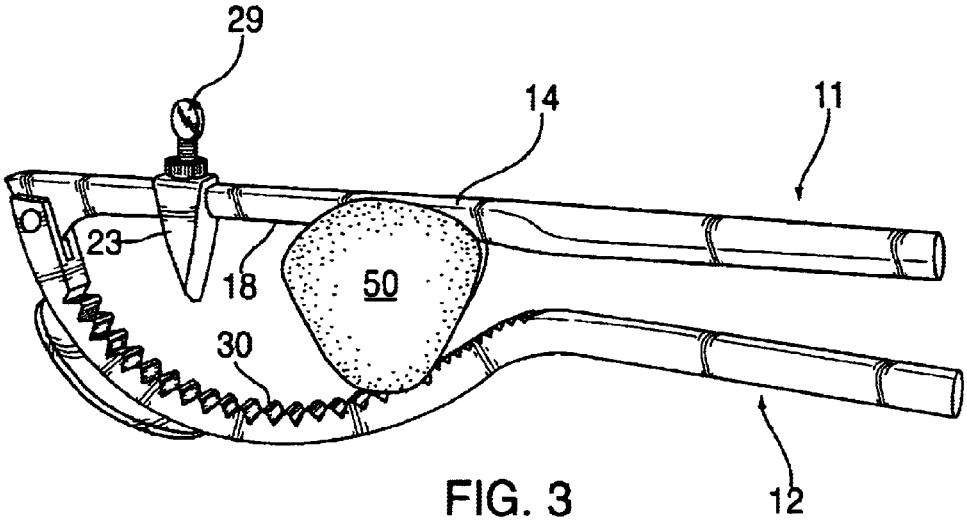
FIG. 3 is a front plan view of the device of FIG. 1 in an operative position with a clam.

To open clams as illustrated in FIG. 3 the wedge shaped member 23 is moved to the far end of wedge portion 14 and locked in place with the setscrew 29. The clam is inserted with one end against the toothed portion 30. The sharp edge 18 of the portion 14 opens the other end of the clam as the members 11 and 12 are squeezed together.

While the invention has been explained by a detailed description of certain specific embodiments, it is understood that various modifications and substitutions can be made in any of them within the scope of the appended claims, which are intended also to include equivalents of such embodiments.

What is claimed is:

1. A device for opening the shells of clams and oysters comprising:

a first member including a handle portion at one end, a knife-like intermediate portion and a downwardly extending portion at the other end;

a second member including a handle portion at one end, a curved internally toothed portion, and an end portion pivotally connected to the downwardly extending portion of the first member;

a wedge shaped member slidably mounted on the knife-like intermediate portion including a downwardly extending end having a sharp edge opposite the toothed portion of the second member, a body portion having an aperture engaged by the knife-like portion of the first member, and a top portion having an aperture extending therethrough to the knife-like portion, and a set screw engaging the aperture to lock the wedge shaped member in position against the knife-like portion; and, wherein a clam may be held at one end by the curved toothed portion and the handles squeezed to bring the knife like intermediate portion between the clam shells to open said clam and wherein an oyster may be held at one end by the curved internally toothed portion and the handle squeezed to bring the sharp edge of the wedge shaped member between the oyster shells to open said oyster.

2. A device for opening clams and oysters in accordance with claim 1 wherein:

the curved internally toothed portion includes an outer surface having a scoop mounted thereto adjacent the pivotally connected end portion to remove the clam or oyster from the shell.

3. A device for opening clams and oysters in accordance with claim 2 wherein:

the downwardly extending end portion of the first member includes a transverse aperture extending therethrough, and the end portion of the second member includes a U-shaped section to accommodate the end portion of the first member, said section having transverse apertures, and including a pin mounted in the transverse apertures to provide pivotal mounting to the first and second member.

4. A device for opening clams and oysters comprising:

a first member having a handle at one end and a knife-like wedge extending axially therealong and a pivotal mounting at the other end;

a wedge shaped member slidable along the knife-like wedge and means for locking said member in place; and, a second member having a handle at one end, a curved internally toothed portion to grip a clam or oyster and a pivotal mounting cooperating with the mounting on the first member wherein the handles are squeezed to bring the first member and second member into cooperation to open a clam or oyster.

5. A device for opening clams and oysters in accordance with claim 4 further including:

a scoop mounted to the curved portion of the second member to remove the clam or oyster from the shell.

* * * * *